US007845135B2

(12) United States Patent
Sibbett

(10) Patent No.: US 7,845,135 B2
(45) Date of Patent: Dec. 7, 2010

(54) WINDOW FRAME

(76) Inventor: Peter Sibbett, 4110 Augusta Dr. NE., Tacoma, WA (US) 98422

( * ) Notice: Subject to any disclaimer, the term of this patent is extended or adjusted under 35 U.S.C. 154(b) by 323 days.

(21) Appl. No.: 12/026,347

(22) Filed: Feb. 5, 2008

(65) Prior Publication Data

US 2009/0013624 A1 Jan. 15, 2009

Related U.S. Application Data

(60) Provisional application No. 60/899,685, filed on Feb. 5, 2007.

(51) Int. Cl.
*E04C 2/38* (2006.01)

(52) U.S. Cl. ..... 52/656.9; 52/656.5; 52/656.6; 52/586.1; 49/504; 403/295

(58) Field of Classification Search ..... 52/656.1, 52/656.2, 656.7, 656.5, 656.6, 656.9, 657, 52/204.5, 586.1, 586.2; 49/501, 504, DIG. 2; 403/295, 331, 382, 403; 40/782
See application file for complete search history.

(56) References Cited

U.S. PATENT DOCUMENTS

| | | | | | |
|---|---|---|---|---|---|
| 61,986 | A * | 2/1867 | Barker | 160/381 |
| 974,380 | A * | 11/1910 | Hoagland | 52/656.7 |
| 2,666,508 | A * | 1/1954 | Nardulli | 52/656.9 |
| 2,703,159 | A * | 3/1955 | Van Fleet | 52/656.5 |
| 3,289,377 | A * | 12/1966 | Hetman | 52/656.5 |
| 3,429,602 | A * | 2/1969 | Dirilgen | 403/295 |
| 3,528,692 | A * | 9/1970 | De Vries | 403/37 |
| 3,797,194 | A * | 3/1974 | Ekstein | 403/295 |
| 4,164,105 | A * | 8/1979 | Herbst et al. | 52/202 |
| 4,240,765 | A * | 12/1980 | Offterdinger | 403/402 |
| 4,624,091 | A * | 11/1986 | Biro | 52/656.5 |
| 5,187,886 | A * | 2/1993 | Wu et al. | 40/759 |
| 5,479,733 | A * | 1/1996 | Kusina | 40/785 |
| 5,547,011 | A * | 8/1996 | Dotson et al. | 160/381 |
| 5,617,660 | A * | 4/1997 | Pollack | 40/606.17 |
| 5,666,773 | A * | 9/1997 | Librande et al. | 52/202 |
| 5,927,668 | A * | 7/1999 | Cyrell | 248/317 |
| 6,318,692 | B1 * | 11/2001 | Cyrell | 248/317 |
| 7,571,574 | B2 * | 8/2009 | Yu | 52/213 |
| 2005/0210777 | A1 * | 9/2005 | Baughn et al. | 52/202 |
| 2008/0216440 | A1 * | 9/2008 | Kobayashi | 52/656.6 |

FOREIGN PATENT DOCUMENTS

WO WO 2005093197 A1 * 10/2005

* cited by examiner

*Primary Examiner*—Robert J Canfield
*Assistant Examiner*—Brent W Herring
(74) *Attorney, Agent, or Firm*—Lahive & Cockfield, LLP; EuiHoon Lee, Esq.

(57) ABSTRACT

The present invention relates to a window frame. According to the present invention, there is provided a window frame, which comprises: a frame unit having a pair of side jamb frames for defining both side ends of the frame unit, an upper jamb frame for defining an upper end thereof, and a sill frame for defining a lower end thereof coupled to each other to have a rectangular frame shape, the frame unit having at least one receiving groove formed in an outer wall surface thereof along a length direction thereof; and corner angles coupled to the frame unit to surround the outer wall surface of the frame unit at corners thereof, each of the corner angles having a concavo-convex portion to be received in the receiving groove, the corner angle having at least one rib protruding from an outer wall surface thereof along a length direction thereof.

9 Claims, 7 Drawing Sheets

WINDOW FRAME

RELATED APPLICATION

This application claims the benefit of U.S. Provisional application No. 60/899,685. The entire contents of the above-identified applications are hereby incorporated by reference in their entirety.

BACKGROUND OF THE INVENTION

1. Field of the Invention

The present invention relates to a window frame, and more particularly, to a window frame, which is configured so that an assembling process can be performed simply and smoothly, and which has novel corner angles allowing conduction of external heat to be minimized and torsional deformation to be prevented.

2. Description of the Related Art

Generally, a window frame is to separate a dwelling space and an un-dwelling space from each other, and various kinds of windows having a door glass installed thereto are slidably installed to the window frame.

Such a window frame includes a sill frame defining a lower end and installed along the ground, and jamb frames defining an upper end and both side ends.

The sill frame and the jamb frames have concavo-convex inner and outer wall surfaces, and are manufactured by a drawing or extruding process.

However, the sill and jamb frames of the conventional window frame are separately manufactured and then assembled by welding the connected surfaces thereof or coupling them through screws or other coupling members. Thus, there is a problem in that the assembling process is difficult.

That is, during the assembling process of the sill and jamb frames, the connected surfaces thereof should be maintained in an accurately matched state. However, it is very difficult for a sole worker to grip and weld or screw the sill and jamb frames.

In particular, when the sill and jamb frames are directly joined to each other, there is a problem in that the joining region thereof is frequently widened or separated with ease.

There are many efforts to prevent the joining region of the sill and jamb frames from being widened or separated by coupling an additional reinforcement, such as a bracket, to each corner of the window frame.

However, the bracket is formed by bending a general metal thin plate, so that it does not have high torsional or bending strength. Thus, there is a problem in that the bracket is easily bent by external force and thus cannot reinforce the joining regions sufficiently.

In particular, the bracket is configured so that both ends thereof are inserted into the sill frame and one of the jamb frames (or two of the jamb frames), so that it should have a very small thickness, which results in very weak strength.

Further, since the conventional reinforcement is made of metal, its entire weight is heavy.

In the meantime, there has been proposed a structure in which the conventional reinforcement itself forms each corner of a window frame in itself and simultaneously couples the sill frame and the jamb frame to each other. However, since such a structure conducts external heat directly to the indoor space, there is a problem in that a heat protection effect is deteriorated.

SUMMARY OF THE INVENTION

The present invention is conceived to solve the aforementioned problems in the prior art. An object of the present invention is to provide a window frame, which is configured so that an assembling process of sill and jamb frames can be performed simply and smoothly and the joining regions thereof are not widened or separated, and which has novel corner angles allowing deformation caused by external force to be prevented.

According to an aspect of the present invention for achieving the objects, there is provided a window frame, which comprises: a frame unit having a pair of side jamb frames for defining both side ends of the frame unit, an upper jamb frame for defining an upper end thereof, and a sill frame for defining a lower end thereof coupled to each other to have a rectangular frame shape, the frame unit having at least one receiving groove formed in an outer wall surface thereof along a length direction thereof; and corner angles coupled to the frame unit to surround the outer wall surface of the frame unit at corners thereof, each of the corner angles having a concavo-convex portion to be received in the receiving groove, the corner angle having at least one rib protruding from an outer wall surface thereof along a length direction thereof.

Here, the rib may be formed on a portion received in the receiving groove.

In addition, the rib may be is formed to have a height to the extent that the rib does not protrude over a height of the outer wall surface of the frame unit.

Further, at least one coupling protrusion may be formed on the outer wall surface of the frame unit, and at least one concave groove may be formed in an inner wall surface of the corner angle so that the coupling protrusion is inserted therein.

Preferably, at least one position guiding groove is formed in an inner wall surface of the frame unit to guide a screwing position, and the position guiding groove is formed to extend along a length direction of the inner wall surface of the frame unit.

A separation preventing projection may be further formed in the receiving groove of the frame unit to prevent the corner angle inserted therein from being separated, and the separation preventing projection may be formed to block a part of an entrance of the receiving groove.

Both ends of the upper jamb frame and both ends of the sill frame of the frame unit may be respectively attached to surfaces of the two side jamb frames facing each other.

In addition, the corner angle may be manufactured by an aluminum die casting process.

Further, the jamb and sill frames may be manufactured by a drawing or extruding process.

According to another aspect of the present invention, there is provided a window frame, which comprises: a frame unit formed by assembling a plurality of jamb frames and a sill frame into a rectangular frame shape; and corner angles respectively installed to surround an outer wall surface of the frame unit at corners thereof, wherein the corner angles are manufactured by an aluminum die casting process.

Here, at least one rib may be formed to protrude on an outer wall surface of each corner angle for reinforcement.

At this time, the rib may be formed to extend along a length direction of the corner angle.

In addition, the jamb and sill frames of the frame unit may be manufactured by a drawing or extruding process.

Further, the frame unit may have a concavo-convex portion formed on the outer wall surface thereof, and the corner angle may have a concavo-convex portion formed on an inner wall surface thereof to have a shape corresponding to the outer wall surface of the frame unit.

Furthermore, at least one position guiding groove may be formed in an inner wall surface of the frame unit to guide a screwing position, and the position guiding groove may be formed to extend along a length direction of the frame unit.

BRIEF DESCRIPTION OF THE DRAWINGS

The above and other features and advantages of the present invention will become apparent from a preferred embodiment given in conjunction with the accompanying drawings, in which.

DESCRIPTION OF THE PREFERRED EMBODIMENT

Hereinafter, a preferred embodiment of a window frame according to the present invention will be described in detail referring to FIGS. 1 to 10.

The window frame according to the preferred embodiment of the present invention includes a frame unit 100 having a rectangular frame shape, and a plurality of corner angles 210, 220, 230 and 240, each of which will be explained below in detail.

Figure 1:
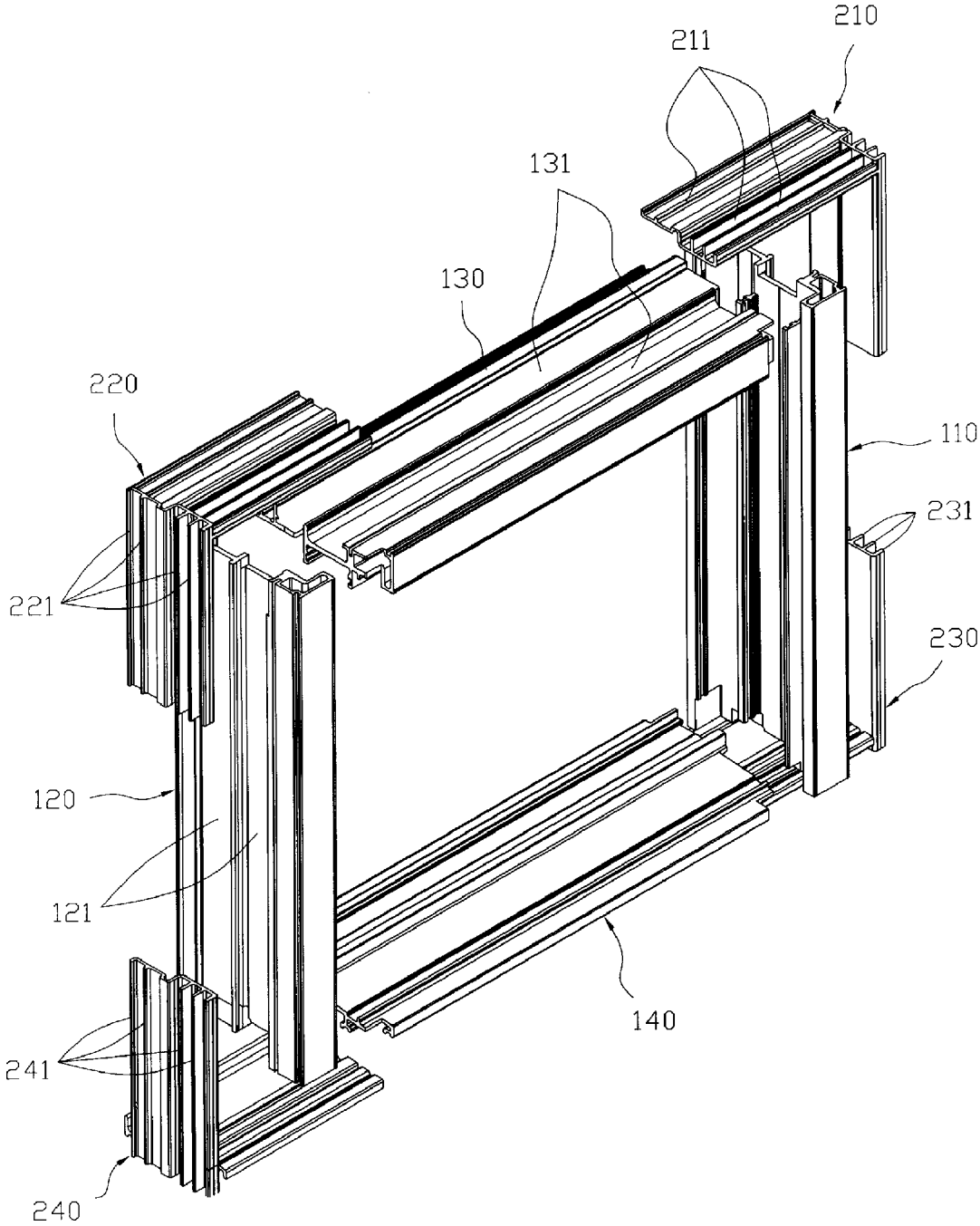
FIG. 1 is an exploded perspective view illustrating an external appearance of a window frame according to a preferred embodiment of the present invention.
Figure 2:
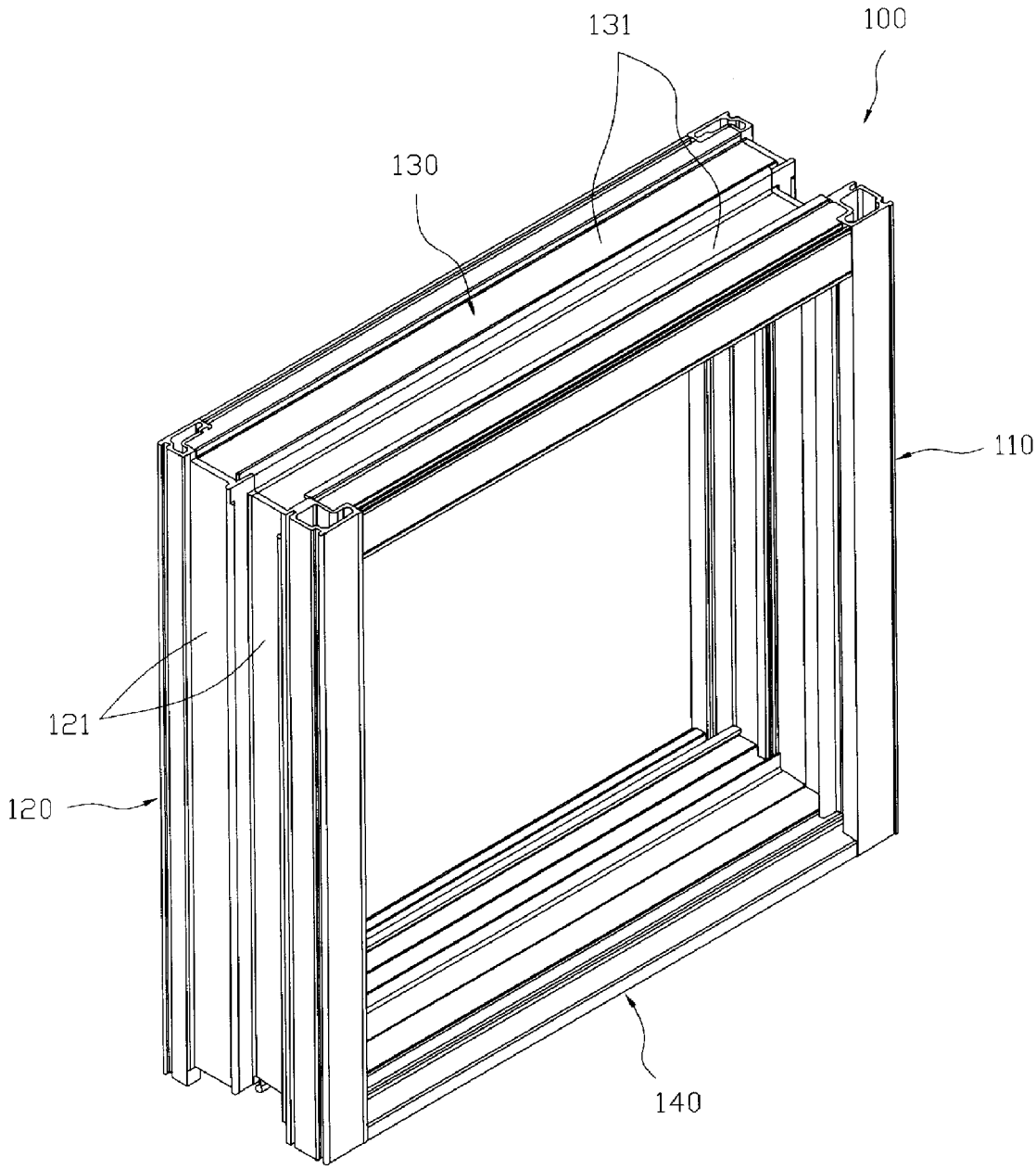
FIG. 2 is a schematic perspective view illustrating a frame unit of the window frame according to the preferred embodiment of the present invention.
Figure 3:
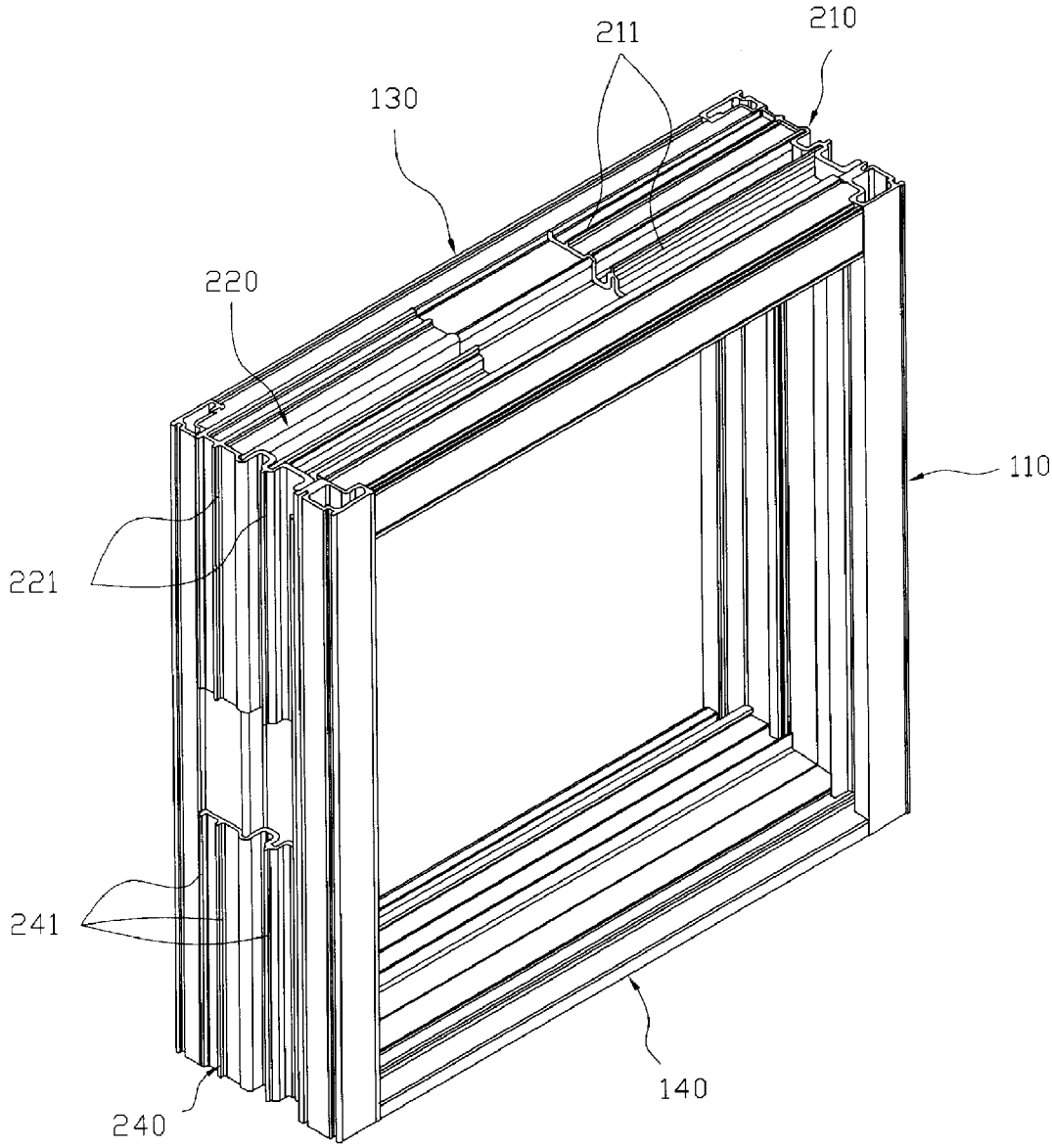
FIG. 3 is a schematic perspective view illustrating that respective corner angles are coupled to the frame unit of the window frame according to the preferred embodiment of the present invention.
Figure 4:
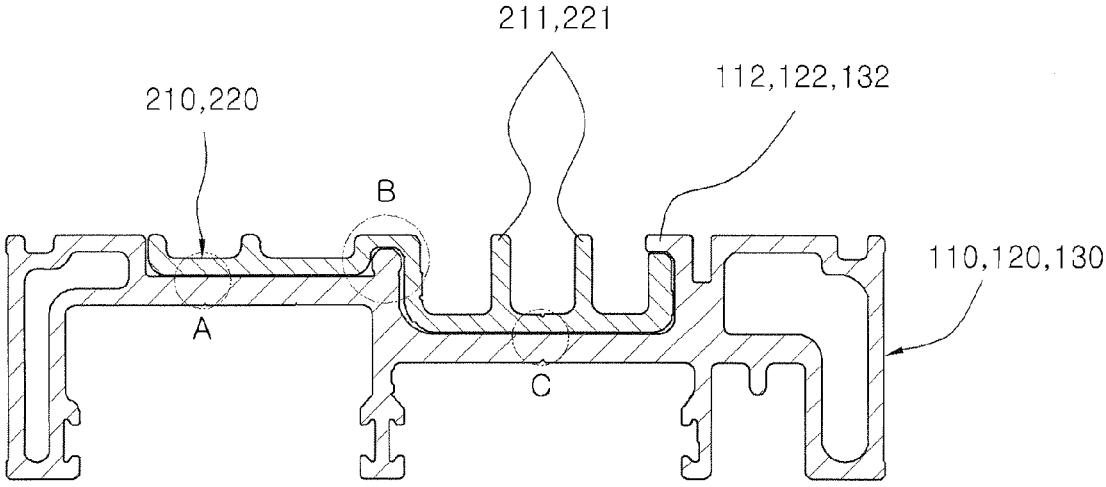
FIG. 4 is a sectional view of a major part illustrating a coupled state of the corner angle and a jamb frame of the frame unit of the window frame according to the preferred embodiment of the present invention.

First, the frame unit 100 is formed in such a manner that a plurality of jamb frames 110, 120 and 130 and a sill frame 140 are assembled into a rectangular frame shape as shown in FIGS. 1 and 2. A window (not shown) is installed in the frame unit 100 to be slidable and swingable.

Here, the jamb frames 110, 120 and 130 are classified into the pair of side jamb frames 110 and 120 defining both side ends of the frame unit 100 and the upper jamb frame 130 defining an upper end of the frame unit 100.

The jamb and sill frames 110, 120, 130 and 140 are manufactured by a drawing or extruding process.

Figure 5:
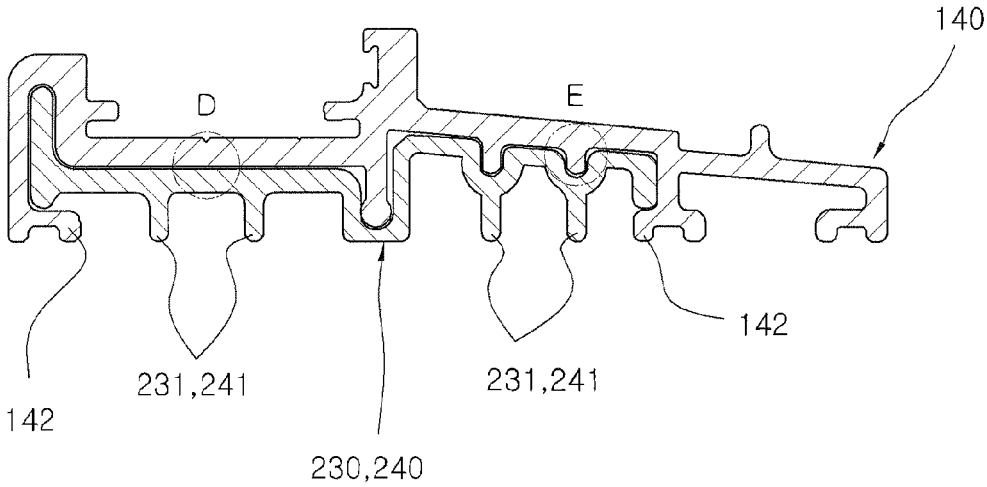
FIG. 5 is a sectional view of a major part illustrating a coupled state of the corner angle and a sill frame of the frame unit of the window frame according to the preferred embodiment of the present invention.
Figure 6:
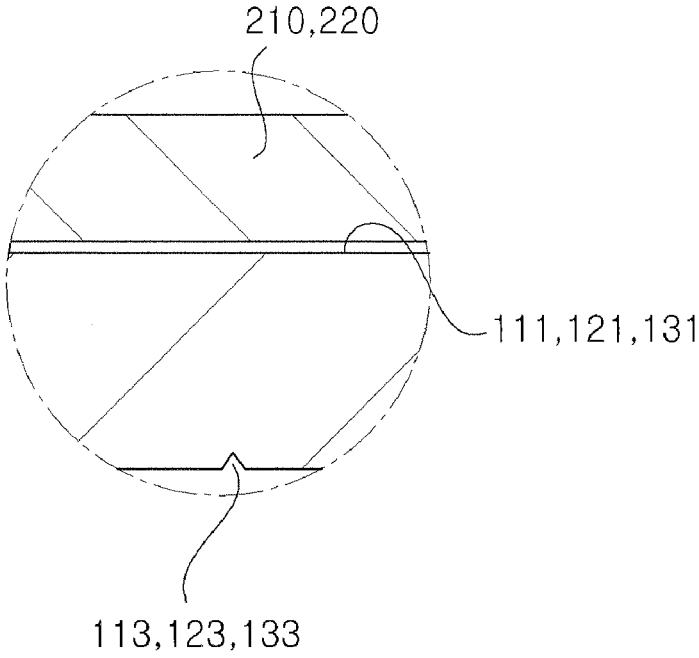
FIG. 6 is an enlarged view of portion "A" depicted in FIG. 4.
Figure 7:
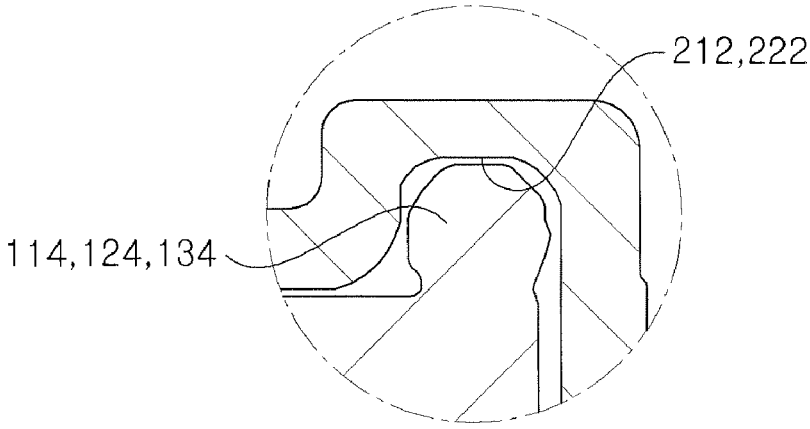
FIG. 7 is an enlarged view of portion "B" depicted in FIG. 4.
Figure 8:
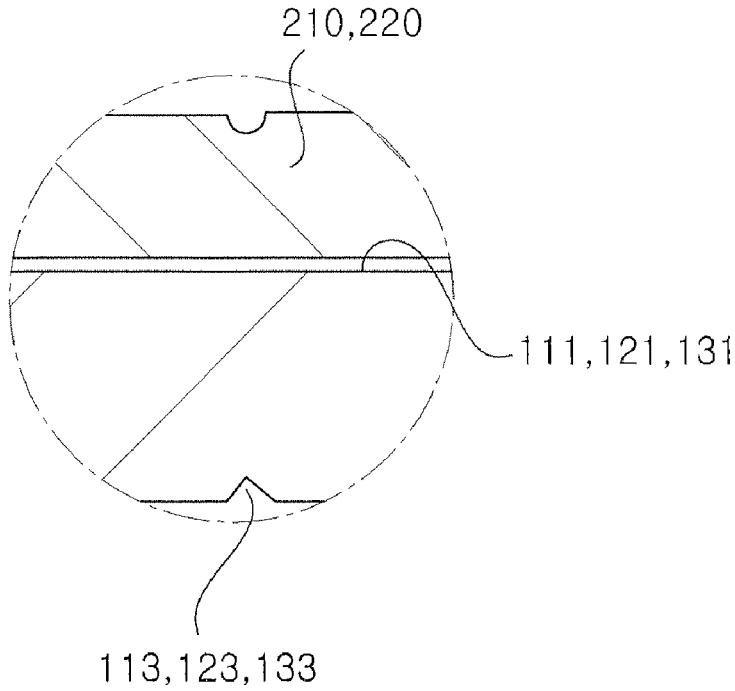
FIG. 8 is an enlarged view of portion "C" depicted in FIG. 4.
Figure 9:
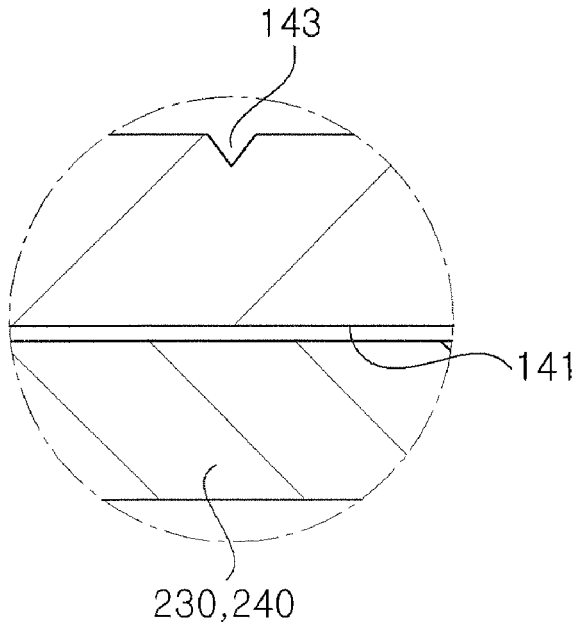
FIG. 9 is an enlarged view of portion "D" depicted in FIG. 5.
Figure 10:
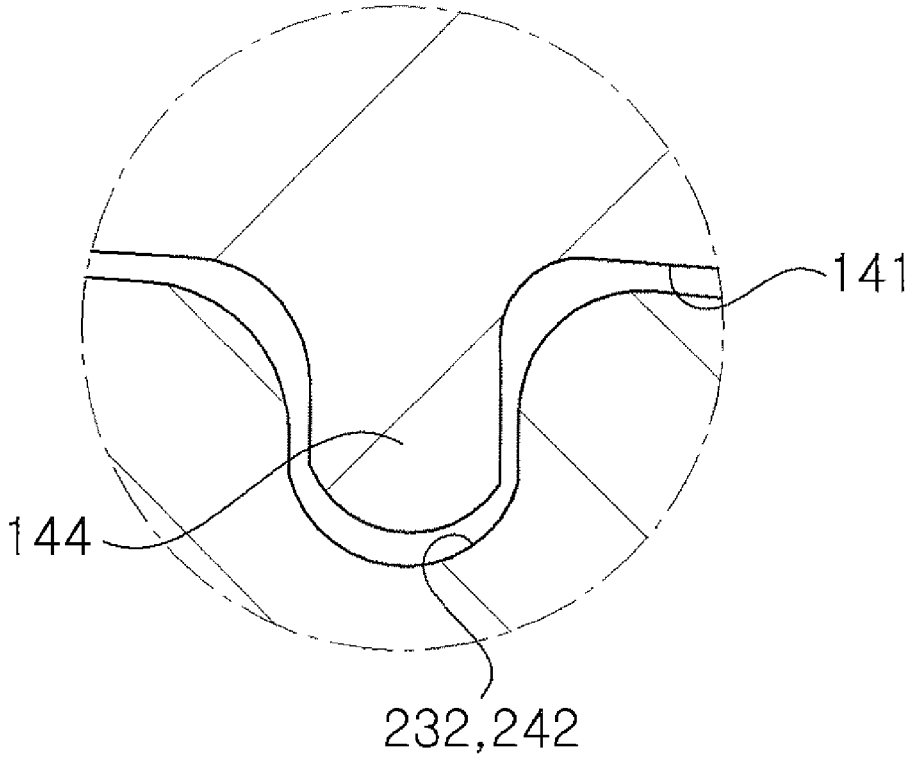
FIG. 10 is an enlarged view of portion "E" depicted in FIG. 5.

In particular, the jamb frames 110, 120 and 130 are designed to have a maximum torsional strength and a minimum weight at the same time. That is, as shown in FIGS. 4 and 6-8, each of the jamb frames 110, 120 and 130 is formed to have both hollow side portions and concavo-convex outer wall surfaces. Of course, the sill frame 140 is also formed to have concavo-convex outer wall surfaces, as shown in FIGS. 5 and 9-10.

The concavo-convex portion of each frame 110, 120, 130 or 140 means that there are receiving grooves 111, 121, 131 or 141 depressed from the surface of the frame. At this time, the receiving grooves 111, 121, 131 or 141 are formed in plural numbers and preferably differ in depth from each other. In this embodiment, the receiving grooves 111, 121, 131 or 141 are formed in a pair in each of the jamb and sill frames 110, 120, 130 and 140, and the two receiving grooves differ in depth from each other.

The jamb and sill frames 110, 120, 130 and 140 may be configured so that the outer wall surfaces (or cross sections) thereof have the same shape or different shapes. For example, in this embodiment, as shown in FIGS. 4-10, the jamb and sill frames are configured so that the outer wall surface (or cross section) of each of the jamb frames 110, 120 and 130 differs in shape from that of the sill frame 140.

In addition, a separation preventing projection 112, 122, 132 or 142 is further formed in the receiving groove 111, 121, 131 or 141 of the frame unit 100 to block a part of an entrance of the receiving grooves 111, 121, 131 or 141 so that the separation preventing projection 112, 122, 132 or 142 can prevent the corner angle 210, 220, 230 or 240 placed in the receiving grooves 111, 121, 131 or 141 from being separated.

Further, in the frame unit 100, both ends of the upper jamb frame 130 and both ends of the sill frame 140 are closely attached to opposite surface of the two side jamb frames 110 and 120, respectively. At this time, the ends of the upper jamb and sill frames 130 and 140 and the portions of the two side jamb frames 110 and 120 to be coupled with the ends are formed to have concavo-convex shapes corresponding to each other.

Furthermore, in this embodiment, at least one position guiding groove 113, 123, 133 or 143 is further formed in an inner wall surface of the frame unit 100 to guide a screwing position.

The position guiding groove 113, 123, 133 or 143 may be formed by depressing only a certain portion (or, a portion used for screwing). However, since the jamb and sill frames 110, 120, 130 and 140 of the frame unit 100 are manufactured by a drawing or extruding process, the position guiding groove 113, 123, 133 or 143 is preferably formed during the drawing or extruding process together with the other portions. Thus, the position guiding groove 113, 123, 133 or 143 is formed to longitudinally extend along the inner wall surface of the frame unit 100.

Next, the corner angles 210, 220, 230 and 240 are provided for coupling the jack frames 110, 120 and 130 of the frame unit 100 and for coupling the sill frame 140 and the two side jack frames 110 and 120, and also for reinforcing the frame unit 100.

There corner angles 210, 220, 230 and 240 are provided in plural numbers so that the corner angles 210, 220, 230 and 240 are respectively coupled to the frame unit 100 so that they surround the outer wall surface of the frame unit 100 at the corners thereof. At this time, the corner angles 210, 220, 230 and 240 are classified into the first corner angle 210 for coupling the upper jamb frame 130 with the side jamb frame 110, the second corner angle 220 for coupling the upper jamb frame 130 with the side jamb frame 120, the third corner angle 230 for coupling the side jamb frame 110 with the sill frame 140, and the fourth corner angle 240 for coupling the side jamb frame 120 with the sill frame 140.

In addition, the corner angles 210, 220, 230 and 240 are manufactured by a die casting process. That is, the corner angles 210, 220, 230 and 240 are entirely formed by a die casting process without a punching or bending process. Accordingly, the corner angles 210, 220, 230 and 240 may be closely attached to the frame unit 100 in an accurately matched state, and the torsional strength can be entirely maximized. In addition, each of the corner angles 210, 220, 230 and 240 is formed as a single piece without any joint, thereby not causing any bending. Accordingly, the two side jamb frames 110 and 120 and the upper jamb frame 130, or the sill frame 140 and the two jamb frames 110 and 120 can be completely prevented from being widened.

In particular, each of the corner angles 210, 220, 230 and 240 is formed to have a concavo-convex surface corresponding to the outer wall surface of the frame unit 100 so that the corner angle can be inserted into the outer wall surface of the frame unit 100. That is, the corner angles 210, 220, 230 and 240 have the concavo-convex surfaces to be inserted into the receiving grooves 111, 121, 131 and 141 of the frame unit 100. Thus, such a configuration makes it possible to prevent the corner angles 210, 220, 230 and 240 from being exposed to the outside and also to allow the corner angles 210, 220, 230 and 240 to be accurately screwed to the frame unit 100 in a stably matched state.

In addition, since the corner angles 210, 220, 230 and 240 are inserted into the frame unit 100 while surrounding the outer wall surface thereof, external heat conducted through the corner angles 210, 220, 230 and 240 is not transferred to the indoor space through the frame unit 100. That is, although heat is conducted to the indoor space through the corner angles 210, 220, 230 and 240, the heat is blocked by the frame unit 100.

Further, at least one rib 211, 221, 231 or 241 is formed to protrude on the outer wall surface of each corner angle 210, 220, 230 or 240. At this time, the rib 211, 221, 231 or 241 is formed to longitudinally extend along each corner angle 210, 220, 230 or 240. The ribs 211, 221, 231 and 241 cause the corner angles 210, 220, 230 and 240 to have more excellent torsional strength, thereby improving an entire torsional strength of the frame unit 100.

In addition, the rib 211, 221, 231 or 241 is preferably formed to have a height to the extent that the rib does not protrude over the height of the outer wall surface of the frame unit 100. This is to make a state where the corner angles 210, 220, 230 and 240 are substantially inserted into the outer wall surface of the frame unit 100.

Meanwhile, in this embodiment, there may be further provided a structure for further improving the coupling strength between the corner angles 210, 220, 230 and 240 and the frame unit 100.

That is, at least one coupling protrusion 114, 124, 134 or 144 is formed to protrude on the outer wall surface of the frame unit 100, and at least one concave groove 212, 222, 232 or 242 is formed in the inner wall surface of each corner angle 210, 220, 230 or 240 so that the coupling protrusion 114, 124, 134 or 144 is inserted into the concave groove.

Hereinafter, an assembling process of the window frame according to the preferred embodiment of the present invention will be explained in detail.

First, any one of the corner angles 210, 220, 230 and 240 is prepared. At this time, if the prepared corner angle is the first corner angle 210, which is coupled to the right upper corner of the window frame in the figure, the upper jamb frame 130 and the right side jamb frame 110 are prepared.

In this state, one end of the upper jamb frame 130 is closely attached to the upper end of the inner wall surface of the prepared side jamb frame 110, and then, the first corner angle 210 is coupled to the outer wall surfaces of the closely attached jamb frames 110 and 130.

At this time, the first corner angle 210 is inserted into the receiving grooves 111 and 131 formed in the outer wall surfaces of the jamb frames 110 and 130 to surround the outer wall surfaces of the two jamb frames 110 and 130. Further, the first corner angle 210 is prevented from being separated from the receiving grooves 111 and 131 by the separation preventing projections 112 and 132 formed on the entrances of the receiving grooves 111 and 131.

In particular, since the coupling projections 114 and 134 protruding from the outer wall surfaces of the jamb frames 110 and 130 are coupled to the concave groove 212 formed in the inner wall surface of the first corner angle 210, the jamb frames 110 and 130 are more stably coupled with the first corner angle 210.

Thereafter, a worker allow a screw to penetrate any portion of the position guiding grooves 113 and 133 formed in the inner wall surfaces of the jamb frames 110 and 130, thereby screwing the jamb frames 110 and 130 and the first corner angle 210 to each other.

At this time, the jamb frames 110 and 130 are made of synthetic resin and the first corner angle 210 is made of aluminum, so that the screw can penetrate them smoothly. In particular, considering that a thread is formed in the first corner angle 210 due to the penetration of the screw, the thread prevents the screw from escaping.

Meanwhile, the process of coupling the first corner angle 210 and the jamb frames 110 and 130 as mentioned above is identically applied when coupling the other corner angles 220, 230 and 240 to the other corners of the frame unit 100.

That is, using the same process as the process of coupling the first corner 210 and the jamb frames 110 and 130, the other corner angles 220, 230 and 240 are coupled to the jamb and sill frames 110, 120, 130 and 140.

Thus, if the corner angles 210, 220, 230 and 240 are completely installed to the four corners of the frame unit 100 by repeating the aforementioned process, the frame unit 100 can keep a stable coupling state and also have more improved torsional strength due to the corner angles 210, 220, 230 and 240.

That is, since each corner angle 210, 220, 230 or 240 is manufactured by an aluminum die casting process, it is possible to maximize a torsional strength. Also, the plurality of ribs 211, 221, 231 and 241 are additionally formed to protrude on the outer wall surfaces of the corner angles 210, 220, 230 and 240, it is possible to provide greater torsional strength.

In addition, the corner angles 210, 220, 230 and 240 have excellent dimension precision, whereby tolerance can be minimized in the assembling thereof. Also, since there is no additional coupling means except that the corner angles 210, 220, 230 and 240 and the frame unit 100 are screwed to each other, it is possible to minimize an assembling time thereof.

The scope of the present invention is not limited to the embodiment described and illustrated above but is defined by the appended claims. It will be apparent that those skilled in the art can make various modifications and changes thereto within the scope of the invention defined by the claims. Therefore, the true scope of the present invention should be defined by the technical spirit of the appended claims.

What is claimed is:

1. A window frame, comprising:

a frame unit having a pair of side jamb frames for defining both side ends of the frame unit, an upper jamb frame for defining an upper end thereof, and a sill frame for defining a lower end thereof coupled to each other to have a rectangular frame shape, the frame unit having at least one receiving groove formed in an outer wall surface thereof along a length direction thereof; and corner angles coupled to the frame unit to surround the outer wall surface of the frame unit at corners thereof, each of the corner angles having a concavo-convex portion to be received in the receiving groove, the corner angle having at least one rib protruding from an outer wall surface thereof along a length direction thereof.

2. The window frame as claimed in claim 1, wherein the rib is formed on a portion received in the receiving groove.

3. The window frame as claimed in claim 2, wherein the rib is formed to have a height to the extent that the rib does not protrude over a height of the outer wall surface of the frame unit.

4. The window frame as claimed in claim 1, wherein at least one coupling protrusion is formed on the outer wall surface of the frame unit, and at least one concave groove is formed in an inner wall surface of the corner angle so that the coupling protrusion is inserted therein.

5. The window frame as claimed in claim 1, wherein at least one position guiding groove is formed in an inner wall surface of the frame unit to guide a screwing position, and the position guiding groove is formed to extend along a length direction of the inner wall surface of the frame unit.

6. The window frame as claimed in claim 1, wherein a separation preventing projection is further formed in the receiving groove of the frame unit to prevent the corner angle inserted therein from being separated, and the separation preventing projection is formed to block a part of an entrance of the receiving groove.

7. The window frame as claimed in claim 1, wherein both ends of the upper jamb frame and both ends of the sill frame of the frame unit are respectively attached to surfaces of the two side jamb frames facing each other.

8. The window frame as claimed in claim 1, wherein the corner angle is manufactured by an aluminum die casting process.

9. The window frame as claimed in claim 1, wherein the jamb and sill frames are manufactured by a drawing or extruding process.

* * * * *